US005710964A

United States Patent [19]

Tombs et al.

[11] Patent Number: 5,710,964

[45] Date of Patent: Jan. 20, 1998

[54] MECHANISM FOR FACILITATING REMOVAL OF RECEIVER MEMBER FROM AN INTERMEDIATE IMAGE TRANSFER MEMBER

[75] Inventors: Thomas N. Tombs, Brockport; Edward T. Miskinis, Rochester; Donald S. Rimai; Robert E. Zeman, both of Webster, all of N.Y.

[73] Assignee: Eastman Kodak Company, Rochester, N.Y.

[21] Appl. No.: 681,637

[22] Filed: Jul. 29, 1996

[51] Int. Cl.[6] ..... G03G 15/14

[52] U.S. Cl. ..... 399/303; 399/308; 399/398

[58] Field of Search ..... 355/273, 274, 355/275, 277, 315; 399/302, 303, 304, 308, 398

[56] References Cited

U.S. PATENT DOCUMENTS

| | | | |
|---|---|---|---|
| 3,781,105 | 12/1973 | Meagher | 355/274 |
| 4,114,536 | 9/1978 | Kaneko et al. | 355/277 |
| 4,163,549 | 8/1979 | Ito et al. | 271/311 |
| 4,712,906 | 12/1987 | Bothner et al. | 355/271 |
| 4,910,558 | 3/1990 | Giezeman et al. | 355/279 |
| 4,931,839 | 6/1990 | Tompkins et al. | 355/277 |
| 5,040,028 | 8/1991 | Kamimura et al. | 355/275 |
| 5,132,743 | 7/1992 | Bujese et al. | 355/274 |
| 5,187,526 | 2/1993 | Zaretsky | 355/273 |
| 5,233,396 | 8/1993 | Simms et al. | 355/275 |
| 5,270,769 | 12/1993 | Satoh et al. | 355/272 |
| 5,278,613 | 1/1994 | Bisaiji et al. | 355/275 X |
| 5,408,302 | 4/1995 | Manzer et al. | 355/285 |
| 5,499,086 | 3/1996 | Matsuno et al. | 355/274 |

FOREIGN PATENT DOCUMENTS

| | | |
|---|---|---|
| 53-25440 | 9/1978 | Japan . |
| 55-100568 | 7/1980 | Japan . |
| 63-193168 | 8/1988 | Japan . |

*Primary Examiner*—Nestor R. Ramirez
*Attorney, Agent, or Firm*—Lawrence P. Kessler

[57] ABSTRACT

A mechanism for facilitating removal of a receiver member from intimate contact with an intermediate image transfer member of a reproduction apparatus having a primary image forming member, an intermediate image transfer member including a compliant outer surface, and a mechanism for electrostatically transferring a marking particle image formed on the primary image forming member from the primary image forming member to the intermediate image transfer member and, thereafter, to a receiver member brought into intimate contact with the intermediate image transfer member. The removal facilitating mechanism includes a member, downstream of the transfer means, in substantial pressure contact with the intermediate image transfer member to compress the outer surface of the intermediate image transfer member, and pinch a receiver member off the intermediate image transfer member.

15 Claims, 2 Drawing Sheets

MECHANISM FOR FACILITATING REMOVAL OF RECEIVER MEMBER FROM AN INTERMEDIATE IMAGE TRANSFER MEMBER

BACKGROUND OF THE INVENTION

The present invention relates in general to reproduction apparatus including an intermediate image transfer member wherein a marking particle image is transferred from a primary image forming member to the intermediate image transfer member and then to a receiver member, and more particularly to a mechanism for facilitating removal of a receiver member from an intermediate image transfer member after transfer of a marking particle image from the intermediate transfer member to the receiver member.

In modern high speed/high quality electrostatographic reproduction apparatus (copier/duplicators or printers), a latent image charge pattern is formed on a uniformly charged dielectric support member. Pigmented marking particles are attracted to the latent image charge pattern to develop such image on the support. The dielectric support is then brought into contact with a receiver member and an electric field applied to transfer the marking particle developed image to the receiver member from the dielectric support. After transfer, the receiver member bearing the transferred image is transported away from the dielectric support and the image is fixed to the receiver member by heat and/or pressure to form a permanent reproduction thereon.

Application of the electric field to effect marking particle transfer is generally accomplished by ion emission from a corona charger onto the receiver member while in contact with the dielectric support, or by an electrically biased roller urging the receiver member against the dielectric support. Roller transfer apparatus offer certain advantages over corona transfer apparatus in that the roller transfer apparatus substantially eliminate defects in the transferred image due to paper cockle or marking particle flakes. This result stems from the fact that the pressure of the roller urging the receiver member against the dielectric support is remarkably efficient in providing intimate uniform contact therebetween. Moreover, in color systems, a receiving sheet can be attached to a roller and the roller rotated to bring the sheet through transfer relationship with a primary image member. An electric field between the drum and the image member superposes a series of single color images on the sheet creating a multicolor image. See, for example, U.S. Pat. No. 4,712,906, Bothner et al, issued Dec. 15, 1987 which is representative of a large number of references in commercial apparatus using this approach.

U.S. Pat. No. 3,781,105 granted to Meagher Dec. 25, 1973 suggests a backing roller for transferring single color images to a receiving sheet. In this instance the reference suggests that the backing roller have an outside layer or layers of a low intermediate conductivity and that a constant current source be used for establishing an electric field. The intermediate conductivity is established by using material having a resistivity of $10^9$ to $10^{11}$ohm-cm. This material is conductive enough to permit the establishment of an electric field but provides a relatively high impedance which causes the field to be less variable in response to variations in the receiving sheet. With such more resistant materials, receiving sheets can vary between paper and transparency stock and also as to thickness and ambient relative humidity without an unacceptable variation in the field that would cause insufficient transfer in some instances or electrical breakdown in others.

Backing rollers having a resistivity in the neighborhood of $10^{10}$ohm-cm are commonly made by doping a high resistance polyurethane material with tiny conductive particles such as carbon, iron or other antistatic materials sufficiently to provide the conductivity needed. Although such backing rollers having a high resistivity are considered preferred in such systems, they do generate problems. If the field is provided between two members that roll in contact with each other, the field is constantly being established through that rolling contact. The substantial resistance of the backing roller increases the time constant in establishing the field thereby either increasing the necessary size of the nip for transfer or reducing the speed of the system.

A number of references show the use of intermediates in both single color image formation and multicolor image formation. For example, FIG. 8 of the above mentioned U.S. Pat. No. 4,712,906 shows a series of single color images being formed on a primary image member. The single color images are transferred in registration to an intermediate roller to create a multicolor image on the surface of the roller. A multicolor image is then transferred in a single step to a receiving sheet at a position remote from the primary image member. This system is particularly advantageous in forming multicolor toner images, because the receiving sheet does not have to be attached to a roller for recirculation but can be fed along a substantially straight path. It can also be used with single color toner image formation for a number of other reasons including facilitating duplex and preventing contact between a primary image member and a receiving sheet which may contaminate the image member with paper fibers and the like.

U.S. Pat. No. 4,931,839 granted to Tompkins et al on Jun. 5, 1990 shows use of an intermediate web of relatively high intermediate conductivity which superposes single color toner images by transfer from a primary image member. The images are transferred to a receiving sheet which is backed by a conductive roller. Substantial impedance does not appear to be provided at this transfer to allow for variations in receiving sheet impedance.

In U.S. Pat. No. 5,187,526 granted to Zaretsky on Feb. 16, 1993, there is shown a transfer arrangement with the advantages that are obtained from use of an intermediate, while still handling a variety of receiving sheets and operating at reasonable speed. In this arrangement, an electrostatic image is formed on a primary image member. Toner is applied to the electrostatic image to create a toner image corresponding to the electrostatic image. The toner image is carried by the primary image member into transfer relation with an intermediate image member having a resistivity less than $10^9$ohm-cm while applying an electric field between the image members sufficient to transfer the toner image to the intermediate image member. The toner image is then brought into transfer relation with a receiving sheet while the receiving sheet is backed by a transfer backing member having a resistivity of $10^{10}$ohm-cm or greater in the presence of an electric field between the intermediate image member and the transfer backing member urging transfer of the toner image to the receiving sheet. The relatively high conductivity of the intermediate image member facilitates efficient transfer of toner images from the primary image member to the intermediate image member using a fairly narrow nip. A high resistance intermediate image member is not necessary at this transfer because no receiving sheet is present. At the second transfer in which the receiving sheet is present, impedance is provided by the transfer backing member rather than the intermediate image member and the nip is somewhat longer allowing for the slower rise time of the electric field.

This arrangement is particularly usable in color processes in which the color image is created on the intermediate image member by superposition of a series of single color images formed on the primary image member. Superposition of the single color toner images on the intermediate image member is facilitated by a more conductive intermediate image member. The second transfer to the receiving sheet is facilitated by the less conductive transfer backing member in that transfer.

One difficulty in using intermediate image members is related to achieving reliable detack of a receiver member from the intermediate image member. Marking particle image transfer has heretofore been compromised to ensure detack because marking particle transfer and detack are accomplished with the same roller. The coupling of marking particle transfer and detack is complicated and imparts significant constraints on the design of the intermediate image member, increases the overall cost of the transfer system, and degrades image quality. Moreover, further problems with the intermediate image member are encountered when receiver members become exposed to a wide range of relative humidities, and also when many different receiver member types and weights are used (especially receiver members with low stiffness such as light weight papers).

SUMMARY OF THE INVENTION

This invention is directed to a mechanism for facilitating removal of a receiver member from intimate contact with an intermediate image transfer member of a reproduction apparatus having a primary image forming member, an intermediate image transfer member including a compliant outer surface, and a mechanism for electrostatically transferring a marking particle image formed on the primary image forming member from the primary image forming member to the intermediate image transfer member and, thereafter, to a receiver member brought into intimate contact with the intermediate image transfer member. The removal facilitating mechanism includes a member, downstream of the transfer means, in substantial pressure contact with the intermediate image transfer member to compress the outer surface of the intermediate image transfer member, and pinch a receiver member off the intermediate image transfer member.

BRIEF DESCRIPTION OF THE DRAWINGS

In the detailed description of the preferred embodiments of the invention presented below, reference is made to the accompanying drawings, in which.

DETAILED DESCRIPTION OF THE PREFERRED EMBODIMENTS

Figure 1:
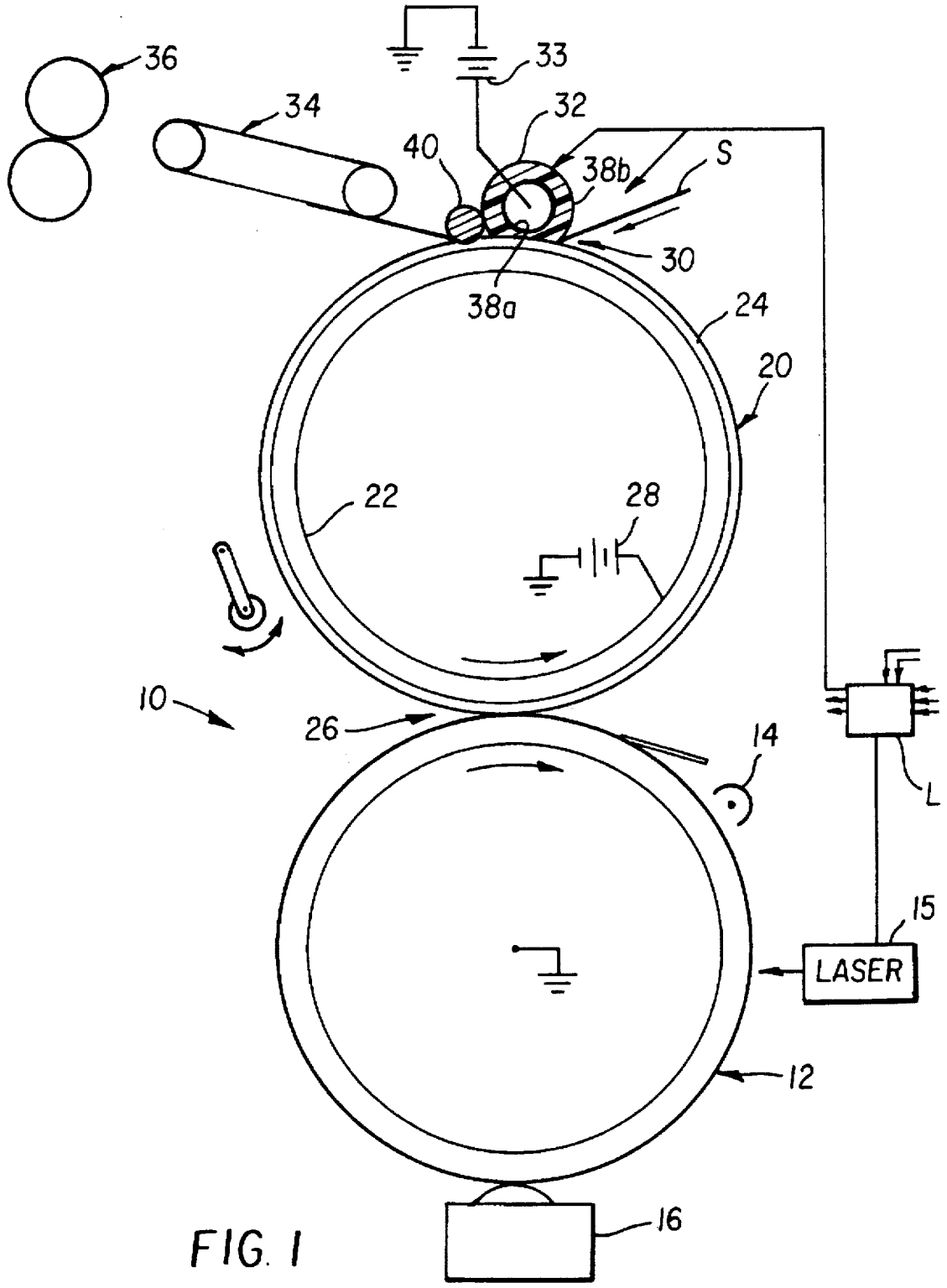
FIG. 1 is a generally schematic side elevational view of an image forming apparatus utilizing an intermediate transfer member with a mechanism for facilitating receiver member release, according to this invention, only basic components being shown for clarity of illustration.

Referring now to the accompanying drawings, FIG. 1 shows an exemplary image forming reproduction apparatus designated generally by the numeral 10. The reproduction apparatus 10 includes a primary image forming member, for example, a drum 12 having a photoconductive surface, upon which a pigmented marking particle image, or series of different color marking particle images, is formed. In order to form images, the outer surface of drum 12 is uniformly charged by a corona charging device 14. The uniformly charged surface is exposed imagewise by suitable exposure means, such as for example, a laser 15 to create a corresponding electrostatic image. The electrostatic image is developed by a application of pigmented marking particles to the image beating photoconductive drum 12 by a development station 16. The development station 16 may include from one to four (or more) separate developing devices. When more than one developing device is provided, each device has particular different color marking particles associated respectively therewith. Each device is separately indexed into operative developing relation with drum 12 to apply different color marking particles respectively to a series of images carried on drum 12 to create a series of different color marking particle images.

The marking particle image is transferred (or multiple marking particle images are transferred one after another in registration) to the outer surface of a secondary or intermediate image transfer member, for example, an intermediate transfer drum 20. The intermediate transfer drum 20 includes a metallic conductive core 22 and a compliant layer 24. The compliant layer 24 is formed of an elastomer such as polyurethane, which has been doped with sufficient conductive material (such as antistatic particles, ionic conducting materials, or electrically conducting dopents) to have a relatively low resistivity (for example, a bulk electrical resistivity preferably in the range of approximately $10^7$–$10^{10}$ ohm-cm). Further, the compliant layer is more than 2 mm thick, preferably between 5 mm and 15 mm, and has a Young's modulus in the range of approximately 0.1 MPa to 10 MPa, and more preferably between 1 MPa and 5 MPa. With such a relatively conductive intermediate image transfer member drum 20, transfer of the single color marking particle images to the surface of drum 20 can be accomplished with a relatively narrow nip 26 and a relatively modest potential of, for example, 600 volts applied by potential source 28.

A single marking particle image, or a multicolor image comprising multiple marking particle images respectively formed on the surface of the intermediate image transfer member drum 20, is transferred in a single step to a receiver member S, which is fed into a nip 30 between intermediate image transfer member drum 20 and a transfer backing member, for example a roller 32. The receiver member S is fed from a suitable receiver member supply (not shown) into nip 30 where it receives the marking particle image. The receiving member exits the nip 30 and is transported by transport mechanism 34 to a fuser 36 where the marking particle image is fixed to the receiver member by application of heat and/or pressure. The receiver member with the fixed marking particle image is then transported to a remote location for operator retrieval.

Appropriate sensors (not shown) of any well known type, such as mechanical, electrical, or optical for example, are utilized in the reproduction apparatus 10 to provide control signals for the apparatus. Such sensors are located along the receiver member travel path between the receiver member supply through the nip 30 to the fuser 36. Further sensors are associated with the primary image forming member photoconductive drum 12, the intermediate image transfer member drum 20, the transfer backing member roller 32, and various image processing stations. As such, the sensors detect the location of a receiver member in its travel path, and the position of the primary image forming member photoconductive drum 12 in relation to the image forming processing stations, and respectively produce appropriate signals indicative thereof. Such signals are fed as input information to a logic and control unit L including a microprocessor, for example. Based on such signals and a suitable program for the microprocessor, the unit L produces signals to control the timing operation of the various electrographic process stations for carrying out the reproduction process. The production of a program for a number of commercially available microprocessors, which are suitable for use with the invention, is a conventional skill well understood in the art. The particular details of any such program would, of course, depend on the architecture of the designated microprocessor.

As noted above, a particular difficulty with the use of the intermediate image transfer member drum and associated transfer backing member roller is that as a receiver member leaves nip between the two, it may have a tendency to electrostatically stick to the intermediate transfer drum. That is, the receiver member may exhibit difficulty in reliably detacking from the intermediate image transfer member drum. The receiver members utilized with the reproduction apparatus 10 can vary substantially. For example, they can be thin or thick paper stock or transparency stock. Each of these types of stock contributes a different impedance to the field associated with the transfer nip 30. Further, variations in relative humidity will vary the conductivity of a paper receiver member, which also causes it to have a varying effect on the impedance of the transfer field. To reduce problems caused by this effect, transfer backing roller 32 is composed of a conductive core **38*a* and an outer layer 38*b* of a relatively high resistance material. For example layer 38*b* can be composed of polyurethane which is been doped with sufficient conductive particles to give it a resistivity of $1.5\times10^{10}$ ohm-cm. The resistance of layer 38*b* is chosen to be sufficiently conductive to be used to establish an electric field for transferring a marking particle image from drum 20** to a receiver member S. At the same time, it is sufficiently nonconductive to provide a substantial impedance in the field which reduces the variation in the field caused by variations in receiver members.

Both layers **38*b* and 24 can be made of polyurethane which has been doped with sufficient antistatic material to provide the described effect. As described above, it has been found that better overall results are achieved in a two transfer system, as shown in FIG. 1, if layer 24 has a conductivity substantially greater than that of layer 38*b*. Accordingly, as an illustrative example, at 21° C. and 50% relative humidity, it is preferable that layer 24 have a resistivity less than $10^9$ ohm-cm, preferably about $10^8$ ohm-cm, and layer 38*b* should have a resistivity greater than $10^8$ ohm-cm, preferably between $10^9$ and $10^{10}$ ohm-cm. The more conductive layer 24 provides good transfer for superposing four single color marking particle images on the surface of layer 24 with a narrower nip 26. On the other hand, nip 30 is somewhat wider, as will be discussed below, to allow for the greater impedance in nip 30**.

In FIG. 1, an arrangement according to this invention is shown for facilitating receiver member detack by decoupling the transfer and detack functions. In the illustrated embodiment, one or more toned images are transferred from the photoconductor drum 12 to the intermediate image transfer member drum 20. The image(s) are transferred to the receiver member S at nip 30, defined by the intermediate image transfer member drum 20 and the transfer backing roller 32 and a detack roller 40. Each of the rollers 32 and 40 backing the receiver member S provide separate and distinct functions. The transfer backing roller 32 is mainly used to supply a transfer field that urges transfer of the marking particle image from the intermediate image transfer member drum 20 to the receiver member, while the detack roller 40 causes the receiver member to detack from the intermediate image transfer member drum by indenting into the compliant layer 24 of the intermediate image transfer member drum. This action of the detack roller 40 pinches the receiver member and forces the receiver member away from the intermediate image transfer member drum.

The transfer backing roller 32 is electrically coupled to a potential source 33 so as to be electrically biased to urge transfer of a marking particle image from the intermediate image transfer member drum 20 to the receiver member S. This electrical bias potential of source 33 may be set to a constant voltage, but is preferably biased at a constant current. A constant current sprays a controlled amount of charge on the back side of the receiver member at the exit from the transfer drum/transfer backing roller nip 30, the region immediately to the left the transfer backing roller 32 in FIG. 1. Preferably, the transfer backing roller is comprised of a conducting core and a blanket which has a bulk electrical resistivity greater than $10^5$ ohm-cm and more preferably between $10^8$–$10^{11}$ ohm-cm. Furthermore, the transfer backing roller 32 is preferably more compliant than the intermediate image transfer member drum 20 so that the intermediate image transfer member drum compresses the transfer backing roller whereby a substantial nip width is achieved, which improves marking particle transfer. In order to make the transfer backing roller 32 more compliant than the intermediate image transfer member drum, the transfer backing roller includes an outer blanket **32*a* of a material having a Young's modulus less than 4 MPa and a thickness between 5 and 30 mm. Suitable materials for the blanket 32*a*** include polyurethane and silicone. To impart the desired resistivity, the blanket material may contain an additive, such as an anti-slat (e.g., metal salts) or small conductive particles (e.g., carbon).

Reliable receiver member detack is achieved by supplying an adequate load to the detack roller 40. The detack roller 40 includes a material which has a substantially higher Young's modulus than the intermediate image transfer member drum blanket 24, causing it to compress the compliant blanket of the intermediate image transfer member drum. An electrical bias may be applied to the detack roller 40 so as to further optimize the transfer of marking particles from the intermediate image transfer member drum 20 to the receiver member S. A detack roller with a small diameter is preferred because it will compress the intermediate image transfer member drum to a particular degree with a smaller applied load than a large diameter roller, and will also allow close proximity to the nip exit of the transfer backing roller 32 which ensures reliable feeding of a variety of different paper types. Suitable materials for the detack roller 40 include stainless steel, aluminum, and also metal rollers coated with a high Young's modulus polyurethane or the like. The detack roller 40 has a resistivity preferably less than $10^{11}$ ohm-cm, and the diameter of the detack roller is preferably between 5 and 30 mm.

Figure 2:
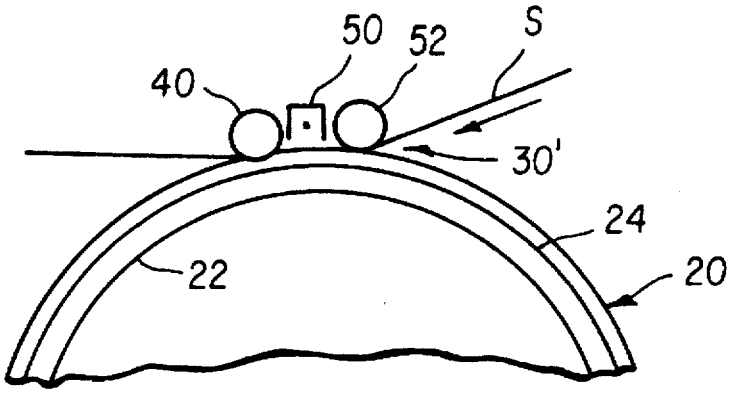
FIG. 2 is a side elevational view of the image forming apparatus shown in FIG. 1. with an alternate embodiment for the intermediate transfer member with a mechanism for facilitating receiver member release.

FIG. 2 shows an alternate embodiment of the detack facilitating mechanism according to this invention. The difference of the alternate embodiment of FIG. 2 from that of the embodiment shown in FIG. 1 is the way in which the transfer field is applied. In this alternate embodiment, the receiver member is charged with a corona charger 50 to urge transfer of marking particle images form the intermediate image transfer member drum 20 to the receiver member S. The charger 50 is located between a pre-nip roller 52 and the detack roller 40. The power supply (not shown) for controlling the charger 50 preferably runs at a constant current so that a controlled amount of charge is supplied to the back side of the receiver member. In this manner, the transfer of marking particle images is made less sensitive to variations in resistivity of the receiver member, which can vary by many orders of magnitude depending on, for example, paper type, the ambient relative humidity, and whether or not the receiver member has previously been subjected to a fusing process.

In the embodiment of FIG. 2, the specifications for the Young's modulus and resistivity of the pre-nip roller 52 are relaxed when compared to the specifications for the transfer backing roller 32 of the embodiment of FIG. 1. This is because the main function of pre-nip roller 52 is not for effecting marking particle image transfer but rather merely to define the transfer nip 30' and to reduce the electric field in the region where the receiver member enters the nip 30'. Proper electrical biasing of the pre-nip roller 52 substantially eliminates ionization and undesired marking particle transfer in the region just prior to the nip 30' (the pre-nip region). Typically, the pre-nip roller 52 is biased to ground potential or near the potential of the intermediate image transfer member drum 20. The function and specifications for the detack roller 40 are substantially the same as described above, but the detack roller may also be electrically biased in a manner which will serve to further optimize the transfer of marking particles.

Figure 3:
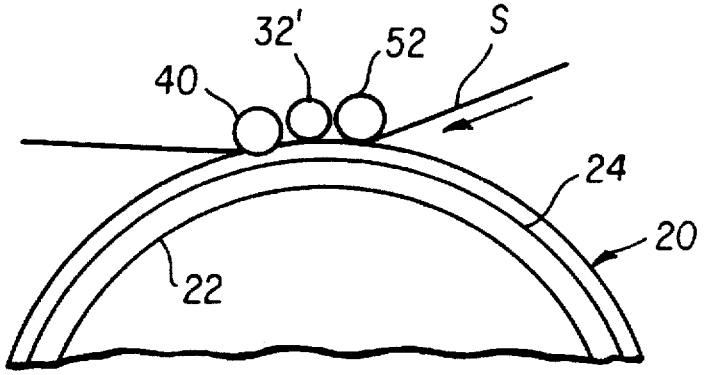
FIG. 3 is a side elevational view of the image forming apparatus shown in FIG. 1. with another alternate embodiment for the intermediate transfer member with a mechanism for facilitating receiver member release.

FIG. 3 shows another alternate embodiment of the detack facilitating mechanism according to this invention. Again, the difference of the alternate embodiment of FIG. 3 from that of the embodiment shown in FIG. 1 is the way the transfer field is applied. In this alternate embodiment three rollers (i.e., rollers 52, 32', and 40) are used for backing the receiver member. The detack roller 40 and the pre-nip roller 52 are as described above with regard to the alternate embodiment of FIG. 2, and may be similarly electrically biased. The transfer field is then largely determined by the electrical bias applied to the roller 32', substantially centrally located between the rollers 52 and 40. Preferably, a constant current is supplied to the roller 32'. The roller 32' thus acts as a charging source which supplies a controlled amount of charge to the back side of the receiver member. As in the other illustrated embodiments, marking particle transfer is less sensitive to variations in the resistivity of the receiver member.

Figure 4:
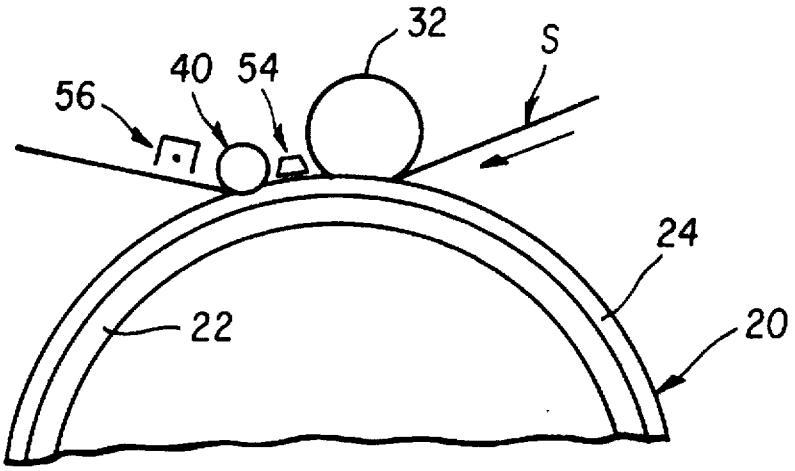
FIG. 4 is a side elevational view of the image forming apparatus shown in FIG. 1. with still another alternate embodiment for the intermediate transfer member with a mechanism for facilitating receiver member release.

In each of the described and illustrated embodiments, it may be necessary to provide a guide structure in the areas adjacent to and/or between the rollers backing the receiver member in order to ensure reliable transport of the receiver member through the transfer station. One example of a guide structure placement is shown in another alternate embodiment of the detack facilitating mechanism according to this invention in FIG. 4. Additionally, a detack charger 56 (also shown in FIG. 4), located downstream of the detack roller 40, may also be used in each of the illustrated embodiments for the purpose of discharging the receiver member, thereby further assisting in receiver member detack and transport.

In all of the described and illustrated embodiments according to this invention, detack is substantially decoupled form the marking particle image transfer process. This allows each process (i.e., transfer and detack) to be separately optimized. Detack is accomplished with a relatively small diameter hard roller which compresses the more compliant intermediate image transfer member drum at much lower pressures then could be realized with the single (dual function) roller described by Zaretsky in the aforementioned U.S. Pat. No. 5,187,526. A separate transfer roller or pre-nip roller and corona charger combination can be optimized for marking particle image transfer without the need to accommodate for receiver member detack. This improves the marking particle transfer process by decreasing ionization in and around the transfer nip and also makes marking particle transfer less sensitive to the wide range of receiver member resistivities typically encountered.

The invention has been described in detail with particular reference to presently preferred embodiments, but it will be understood that variations and modifications can be effected within the spirit and scope of the invention.

What is claimed is:

1. A reproduction apparatus comprising:

a primary image forming member;

an intermediate image transfer member including a compliant outer surface;

means for electrostatically transferring a marking particle image formed on said primary image forming member from said primary image forming member to said intermediate image transfer member and, thereafter, to a receiver member brought into intimate contact with said intermediate image transfer member; and a compressing member, for facilitating removal of said receiver member from intimate contact with said intermediate image transfer member, said compressing member including a roller of relatively small diameter in the range of 5 up to 30 mm, said roller having an outer surface of a high Young's modulus when compared to that of said compliant outer surface of said intermediate image transfer member, said roller located downstream of said transfer means, in substantial pressure contact with said intermediate image transfer member to compress said compliant outer surface of said intermediate image transfer member, so as to be able to pinch a receiver member off said intermediate image transfer member.

2. The reproduction apparatus according to claim 1 further including a detack charger located downstream of said compressing member roller.

3. The reproduction apparatus according to claim 1 wherein said means for electrostatically transferring a marking particle image includes a transfer roller in nip relation with said intermediate image transfer member upstream of said compressing member roller, and an electric potential source coupled to said transfer roller.

4. The reproduction apparatus according to claim 3 wherein said electric potential source coupled to said transfer roller is a constant current source.

5. The reproduction apparatus according to claim 3 wherein said transfer roller has an outer surface which is more compliant than said compliant outer surface of said intermediate image transfer member.

6. The reproduction apparatus according to claim 3 further including a pre-nip roller in contact with said intermediate image transfer member upstream of said transfer roller.

7. The reproduction apparatus according to claim 1 wherein said means for electrostatically transferring a marking particle image includes a corona charger in operative association with said intermediate image transfer member, and an electric potential source coupled to said corona charger.

8. The reproduction apparatus according to claim 7 further including a pre-nip roller in contact with said intermediate image transfer member upstream of said corona charger.

9. The reproduction apparatus according to claim 1 further including guide structure associated with said intermediate image transfer member, between said marking particle transfer means and said compressing member, for guiding transport of a receiver member during intimate contact with said intermediate image transfer member.

10. The reproduction apparatus according to claim 1 wherein said compliant outer surface of said intermediate image transfer member has a Young's modulus in the range of between 0.1 MPa and 10 MPa.

11. The reproduction apparatus according to claim 1 wherein said compliant outer surface of said intermediate image transfer member has a Young's modulus is between 1 MPa and 5 MPa.

12. The reproduction apparatus according to claim 1 wherein said compliant outer surface of said intermediate image transfer member has a thickness greater than 2 mm.

13. The reproduction apparatus according to claim 1 wherein said compliant outer surface of said intermediate image transfer member has a thickness in the range of between 5 mm and 15 mm.

14. The reproduction apparatus according to claim 1 wherein said compliant outer surface of said intermediate image transfer member has a Young's modulus between 1 MPa and 5 MPa, and a thickness in the range of between 5 mm and 15 mm.

15. The reproduction apparatus according to claim 14 wherein said outer surface of said intermediate image transfer member has a bulk resistivity between $10^9$ and $10^{11}$ ohm-cm.

* * * * *